US006062197A

United States Patent [19]

Janic et al.

[11] Patent Number: 6,062,197

[45] Date of Patent: May 16, 2000

[54] HYBRID POWER GOVERNOR

[75] Inventors: Dusan M. Janic; Randal L. Bergstedt, both of Columbus; Larry L. Barnett, N. Vernon; Eric R. Richardson, Columbus; Kevin E. Lowe, N. Vernon, all of Ind.

[73] Assignee: Cummins Engine Company, Inc., Columbus, Ind.

[21] Appl. No.: 09/094,788

[22] Filed: Jun. 15, 1998

[51] Int. Cl.[7] ..... F02D 31/00

[52] U.S. Cl. ..... 123/357; 123/358

[58] Field of Search ..... 123/357, 358, 123/359

[56] References Cited

U.S. PATENT DOCUMENTS

| | | | |
|---|---|---|---|
| 3,699,935 | 10/1972 | Adler | 123/357 |
| 3,707,950 | 1/1973 | Schlimme | 123/357 |
| 4,357,920 | 11/1982 | Stumpp | 123/357 |
| 4,566,417 | 1/1986 | Suzuki | 123/357 |
| 4,811,712 | 3/1989 | Itow | 123/357 |
| 4,836,165 | 6/1989 | Kubota | 123/357 |
| 4,917,063 | 4/1990 | Hiraki | 123/357 |
| 5,067,461 | 11/1991 | Joachim et al. | 123/357 |
| 5,293,852 | 3/1994 | Lehner et al. | 123/339 |
| 5,293,853 | 3/1994 | Berger et al. | 123/357 |
| 5,315,977 | 5/1994 | Fosseen | 132/357 |
| 5,323,746 | 6/1994 | Best et al. | 123/357 |
| 5,339,781 | 8/1994 | Osawa | 123/357 |
| 5,343,780 | 9/1994 | McDaniel et al. | 477/108 |
| 5,419,294 | 5/1995 | Dingle | 123/399 |
| 5,479,908 | 1/1996 | Grinberg et al. | 123/386 |
| 5,483,940 | 1/1996 | Namba et al. | 123/497 |
| 5,526,786 | 6/1996 | Beck | 123/357 |
| 5,697,339 | 12/1997 | Esposito | 123/357 |

*Primary Examiner*—Carl S. Miller
*Attorney, Agent, or Firm*—Woodard, Emhardt, Naughton Moriarty & McNett

[57] ABSTRACT

The present invention relates to an engine governor which interpolates between several fueling power curves based upon throttle position and engine speed. Each of the curves are chosen so as to provide a consistent power rise with decreasing engine speed at throttle positions less than maximum. The curves are chosen so as to eliminate an abrupt transition between the given fueling curve and the 100% fueling curve. This is preferably accomplished by having the fueling curve exhibit a knee at the transition to the 100% fueling curve. This gives the driver an indication that the throttle position will not maintain the desired speed under the current loading conditions, thereby prompting the driver to increase the throttle position, thereby allowing the throttle to be used to simulate infinite gear shifts between actual transmission gear shifts.

12 Claims, 3 Drawing Sheets

HYBRID POWER GOVERNOR

TECHNICAL FIELD OF THE INVENTION

The present invention generally relates to control systems for internal combustion engines and, more particularly, to a hybrid power governor for an internal combustion engine.

BACKGROUND OF THE INVENTION

It is known to provide a governor system for the fuel pump of an internal combustion engine which is used to power a vehicle, such as an agricultural vehicle or a road vehicle. For vehicles which are used to move heavy loads, it is the usual practice to provide a so-called all speed governor system, since the fueling characteristic provided by such a system is ideal for use when the vehicle is in a loaded state. In such a system, the driver of the vehicle sets the required engine speed (and hence the ground speed) with the vehicle throttle, and the all speed governor system adjusts the fuel supply to the engine so as to attain and maintain the required speed (within the power capability of the engine and any other restraints placed upon the system).

A typical prior art all speed governor fueling curve family is illustrated in FIG. 1. The graph shows the power developed by an engine versus engine speed for any particular throttle position maintained by the driver. The fueling to the engine to produce these power curves is substantially linearly proportional to the power produced. The curve 10 represents one hundred percent (100%) (or maximum) fueling of the engine. An existing problem with prior art all speed governors, such as in engines used in agricultural applications, is the so-called lug back characteristics of the governor at partial throttle operation. For example, the engine may be operated at seventy percent (70%) throttle at engine speed A, which will place the all speed governor at position 12 on the diagram of FIG. 1. If the vehicle is pulling an agricultural implement, such as a plow, and the implement encounters increased resistance, such as a patch of hard earth, this will have a tendency to slow the vehicle and hence slow the engine speed to the point B. This will place the all speed governor at position 14 on the 70% throttle curve. It will be noted that the engine is now producing more power in order to return the engine speed back to point A. Further slowing of the vehicle (i.e. as a result of increased resistance within the earth) will cause the engine speed to slow to point C, placing operation of the all speed governor at point 16 on the 70% throttle curve. At this point, the 70% throttle curve is limited to the 100% fueling curve 10. Any further resistance on the agricultural implement will cause the vehicle to slow further, which will actually result in the engine producing less power, thereby slowing further, which causes the vehicle to produce less power, et cetera. The perception of the driver of the vehicle is a rapid slow down of the vehicle and a perceived loss of power. The driver will have no other choice than to downshift or to lift the implement out of the ground.

The problem with this all speed governor characteristic occurs in the region 18. Because of the sharp transition at the point where the partial throttle curve intersects the 100% fueling curve, the driver receives no warning before the vehicle begins to slow down rapidly and lose power. As the governor transitions from engine speeds A to B to C, the engine continues to increase its power output in an attempt to regain the original engine speed. However, any further reduction of engine speed causes the engine to lose power, therefore causing the vehicle to slow down rapidly.

The main concern with this form of operation is that no warning is given to the driver before the all speed governor transitions to the 100% fueling curve 10 and the vehicle begins to abruptly lose power. Once on the 100% fueling curve 10, further depression of the throttle will have no effect in increasing the speed of the vehicle. Therefore, the undesirable result of the all speed governor is that it causes the engine to increase power as the vehicle slows until it reaches the intersection 16 with the 100% fueling curve, at which point it suddenly begins to lose power, without any advance warning to the driver. There is therefore a need for an engine governor which does not produce this undesirable result. The present invention is directed to meeting this need.

SUMMARY OF THE INVENTION

The present invention relates to an engine governor which interpolates between several fueling power curves based upon throttle position and engine speed Each of the curves are chosen so as to provide a consistent power rise with decreasing engine speed at throttle positions less than maximum. The curves are chosen so as to eliminate an abrupt transition between the given fueling curve and the 100% fueling curve. This is preferably accomplished by having the fueling curve exhibit a knee at the transition to the 100% fueling curve. This gives the driver an indication that the throttle position will not maintain the desired speed under the current loading conditions, thereby prompting the driver to increase the throttle position, thereby allowing the throttle to be used to simulate infinite gear shifts between actual transmission gear shifts.

In one form of the invention, a method for fueling an internal combustion engine is disclosed, comprising the steps of: providing a database comprising a plurality of engine fueling command values indexed by engine speed and commanded throttle percentage, wherein for any one of said commanded throttle percentages, respective ones of said fueling command values as a function of respective ones of said engine speeds exhibit at least two slopes between a 0% fueling command value and a 100% fueling command value; sensing a first commanded throttle percentage of said engine; sensing a first engine speed of said engine; retrieving a first fueling command value, corresponding to said first commanded throttle percentage and said first engine speed, from said database; and fueling said engine in proportion to said first fueling command value.

In another form of the invention, a method for fueling an internal combustion engine is disclosed, comprising the steps of: providing a database comprising a plurality of engine fueling command values indexed by engine speed and commanded throttle percentage, wherein for any one of said commanded throttle percentages, respective ones of said fueling command values as a function of respective ones of said engine speeds exhibit a knee between a 0% fueling command value and said 100% fueling command value; sensing a first commanded throttle percentage of said engine; sensing a first engine speed of said engine; retrieving a first fueling command value, corresponding to said first commanded throttle percentage and said first engine speed, from said database; and, fueling said engine in proportion to said first fueling command value.

In another form of the invention, a method for fueling an internal combustion engine is disclosed, comprising the steps of: providing a database comprising a plurality of engine fueling command values indexed by engine speed and commanded throttle percentage, wherein for any one of said commanded throttle percentages, a rate of change of respective ones of said fueling command values as a function of respective ones of said engine speed is non-constant between a 0% fueling command value and a 100% fueling command value; sensing a first commanded throttle percentage of said engine; sensing a first engine speed of said engine; retrieving a first fueling command value, corresponding to said first commanded throttle percentage and said first engine speed, from said database; and, fueling said engine in proportion to said first fueling command value.

In another form of the invention, a hybrid power governor for an internal combustion engine having a throttle is disclosed, comprising: a computer memory device containing a database comprising a plurality of engine fueling command values indexed by engine speed and commanded throttle percentage, wherein for any one of said commanded throttle percentages, respective ones of said fueling command values as a function of respective ones of said engine speeds exhibit at least two slopes between a 0% fueling command value and a 100% fueling command value; an engine control module coupled to said computer memory device for retrieving said fueling command values; a throttle position sensor coupled to said throttle and to said engine control module and operative to sense a current commanded throttle percentage and supply said current commanded throttle percentage to said engine control module; an engine speed sensor coupled to said engine and to said engine control module and operative to sense a current engine speed and supply said current engine speed to said engine control module; and, a fuel system coupled to said engine and to said engine control module and operative to receive a fueling command value from said engine control module and to fuel said engine in response thereto; wherein said engine control module retrieves a current fueling command value from said database based upon said current commanded throttle percentage and said current engine speed and supplies said current fueling command value to said fuel system in order to fuel said engine.

In another form of the invention, a hybrid power governor for an internal combustion engine having a throttle comprising: a computer memory device containing a database comprising a plurality of engine fueling command values indexed by engine speed and commanded throttle percentage, wherein for any one of said commanded throttle percentages, respective ones of said fueling command values as a function of respective ones of said engine speeds exhibit a knee between a 0% fueling command value and said 100% fueling command value; an engine control module coupled to said computer memory device for retrieving said fueling command values; a throttle position sensor coupled to said throttle and to said engine control module and operative to sense a current commanded throttle percentage and supply said current commanded throttle percentage to said engine control module; an engine speed sensor coupled to said engine and to said engine control module and operative to sense a current engine speed and supply said current engine speed to said engine control module; and, a fuel system coupled to said engine and to said engine control module and operative to receive a fueling command value from said engine control module and to fuel said engine in response thereto; wherein said engine control module retrieves a current fueling command value from said database based upon said current commanded throttle percentage and said current engine speed and supplies said current fueling command value to said fuel system in order to fuel said engine.

In another form of the invention, a hybrid power governor for an internal combustion engine having a throttle is disclosed, comprising: a computer memory device containing a database comprising a plurality of engine fueling command values indexed by engine speed and commanded throttle percentage, wherein for any one of said commanded throttle percentages, a rate of change of respective ones of said fueling command values as a function of respective ones of said engine speed is non-constant between a 0% fueling command value and a 100% fueling command value; an engine control module coupled to said computer memory device for retrieving said fueling command values; a throttle position sensor coupled to said throttle and to said engine control module and operative to sense a current commanded throttle percentage and supply said current commanded throttle percentage to said engine control module; an engine speed sensor coupled to said engine and to said engine control module and operative to sense a current engine speed and supply said current engine speed to said engine control module; and, a fuel system coupled to said engine and to said engine control module and operative to receive a fueling command value from said engine control module and to fuel said engine in response thereto; wherein said engine control module retrieves a current fueling command value from said database based upon said current commanded throttle percentage and said current engine speed and supplies said current fueling command value to said fuel system in order to fuel said engine.

DETAILED DESCRIPTION OF THE PREFERRED EMBODIMENTS

Figure 1:
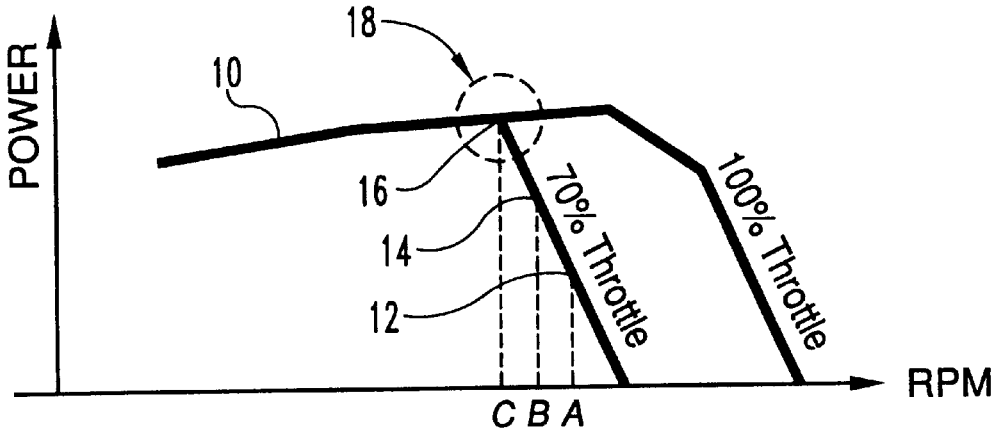
Fig. 1 (Prior Art)
FIG. 1 is prior art all speed governor fueling curve illustrating engine power versus engine speed for 70% throttle and 100% fueling.

For the purposes of promoting an understanding of the principles of the present invention, reference will now be made to the embodiments illustrated in the drawings and specific language will be used to describe the same. It will nevertheless be understood that no limitation of the scope of the present invention is thereby intended, such alterations and further modifications in the illustrated articles of manufacture, and such further applications of the principles of the present invention as illustrated therein being contemplated as would normally occur to one skilled in the art to which the present invention relates.

Figure 2:
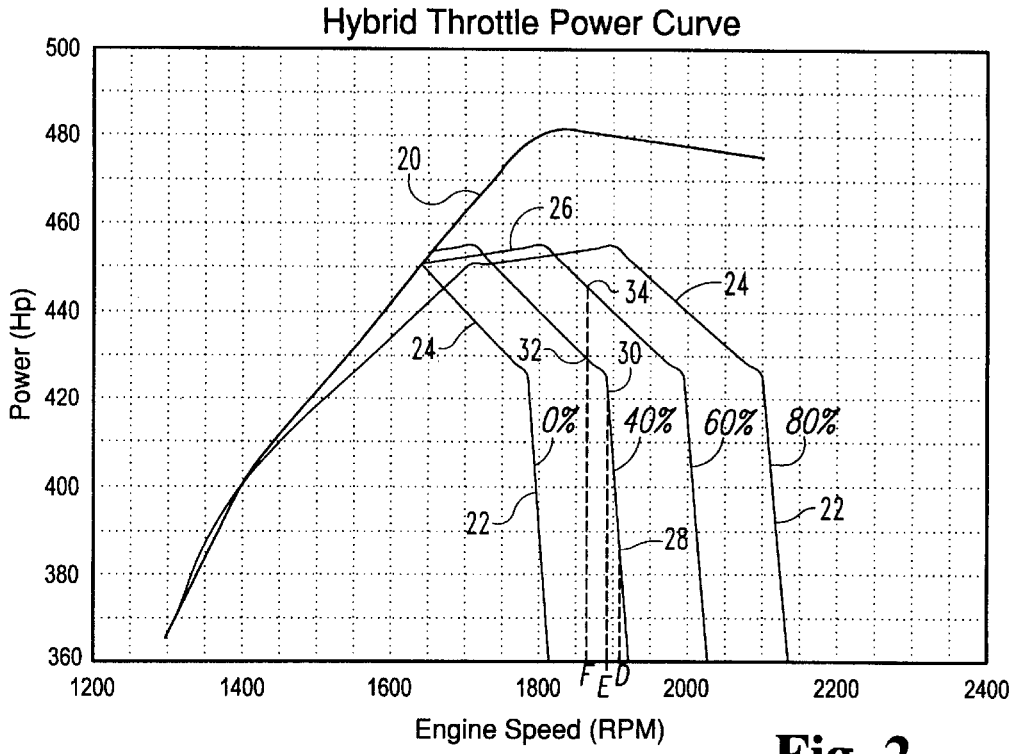
FIG. 2 is a preferred embodiment hybrid throttle power curve of the present invention illustrating engine power versus engine speed for several throttle positions.
Figure 3:
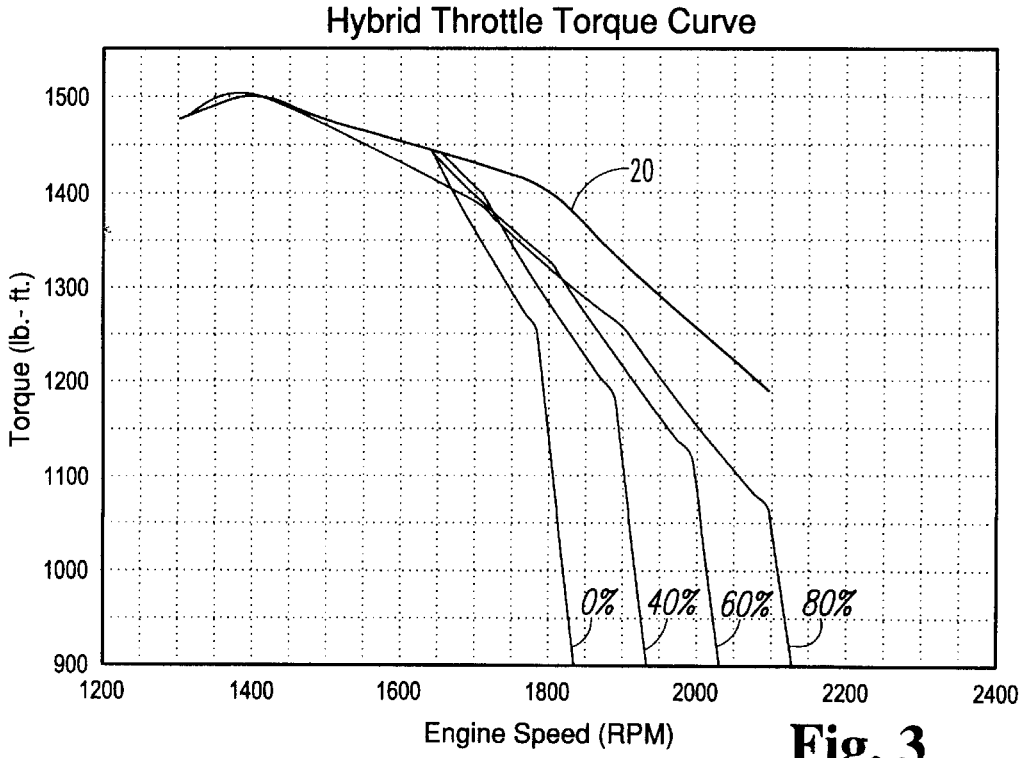
FIG. 3 is a preferred embodiment hybrid throttle torque curve of the present invention illustrating engine torque versus engine speed for several throttle positions.

Referring now to FIG. 2, there is illustrated a preferred embodiment hybrid power governor power curve family according to the present invention, while the equivalent hybrid power governor torque curves are illustrated in FIG. 3. Each of the power curves is associated with a particular commanded throttle position, as indicated. The 100% fueling curve is indicated at 20. As can be seen with reference to FIG. 2, each of the throttle power curves exhibit at least two distinct slopes prior to transitioning to the 100% fueling curve 20. In particular, each of the power curves has a region 22 of relatively steep slope, which is followed by a region 24 of relatively less slope, which is in turn followed by a region 26 which transitions to the 100% fueling curve 20. It is the "knee" 24 which gives a warning to the driver that the governor is transitioning toward the 100% fueling curve, thereby necessitating an increase in throttle position, a downshift, or a lightening of the load (e.g. lifting the towed implement out of the ground).

For example, suppose that the vehicle is towing a plow and operating at the speed D with a 40% throttle, corresponding to the point 28 on the hybrid throttle power curve of FIG. 2. An increase in the load on the plow may decrease the vehicle speed to E, thereby moving the operating point on the hybrid throttle power curve of FIG. 2 to 30. With no change in the driver's throttle command, the governor will change the engine fueling in order to increase the horsepower output of the engine by approximately 35 hp in an effort to regain the engine speed D. However, suppose that the load further increases upon the implement, further sowing the vehicle speed to F. This will place the governor at the point 32 on the hybrid throttle power curve. Although the speed has slowed by a greater amount in the transition from E to F, the governor commands an increase in output power of only approximately 8 hp. This lessening of the horsepower increase with lessening vehicle speed is a cue to the driver that the vehicle will not be able to maintain the desired speed with the given load conditions if the throttle position is maintained. In other words, the driver perceives that the engine is losing its battle to keep up with the increase in loading. The driver is therefore prompted to increase the throttle positioning, say to 60%. At the current engine speed of F, this increased throttle position (at the point 34) will provide approximately an additional 15 hp in an effort to return the engine speed to D.

The knee 24 in the hybrid throttle power curves provides feedback to the driver that the hybrid power governor is beginning to head toward the 100% fueling curve 20, thereby necessitating either an increase in throttle position from the driver or a downshift. This cue is given to the driver before actually reaching the 100% fueling curve 20, thereby preventing the situation where the vehicle slows down rapidly and exhibits a dramatic loss of power. Once the 100% fueling curve 20 has been reached, the driver's only option is to downshift or to decrease the load. Increasing the throttle position at this point would have no effect. By providing the knee 24 in the present invention, the driver is given a chance to increase the throttle position in order to bring the engine speed back to the desired point. Furthermore, the vehicle does not exhibit such a dramatic slow down before the driver is able to take corrective action, thereby preserving much of the vehicle's forward momentum.

In a preferred embodiment of the present invention, the hybrid power governor is implemented as a microprocessor-based engine control module which has associated memory storing an engine fueling database which will reproduce the hybrid th rote power curves of FIG. 2 for any given engine speed and throttle position. Be cause of memory space limitations, only fueling curves for particular throttle positions will be stored, thereby necessitating the need for interpolation for throttle positions and/or engine speeds that fall between data points stored in the database. Although the curves of FIG. 2 are illustrated having data representing 0%, 40%, 60% and 80% throttle positions, those having ordinary skill in the art will recognize any desired throttle position curves may be stored in memory to be used as a basis for look-up and interpolation.

Figure 4:
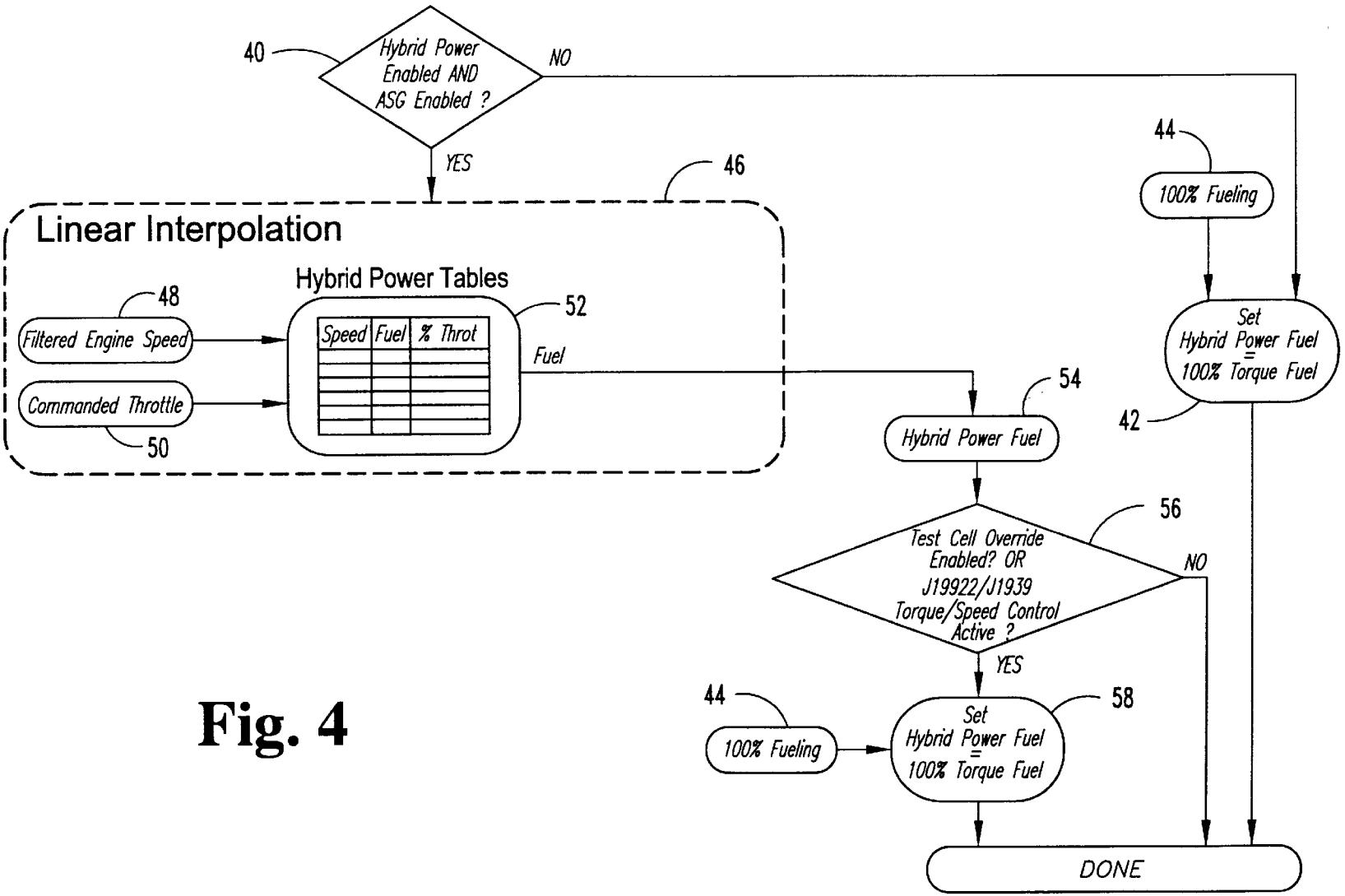
FIG. 4 is a schematic process flow diagram of a preferred embodiment hybrid power governor of the present invention.

This is illustrated in FIG. 4, which contains a schematic process flow diagram illustrating the use of a hybrid power governor of the present invention. The process begins at step 40 which simply determines whether or not the hybrid power governor function has been enabled for the current engine. This feature allows the engine control module software to contain the functionality for the hybrid power governor, but this feature may be turned off if it is not desired for the particular engine. If the hybrid power governor is not enabled, then the process proceeds to step 42 which sets the hybrid power fueling command (the value given to the engine fueling system, such as a fuel injection system, in order to determine the amount of fuel delivered to the engine) equal to the 100% fueling value. The 100% fueling value is input from values stored in an associated computer memory, as indicated at 44. The process is then exited.

If decision block 40 determines that the hybrid power governor of the present invention has been enabled, then the process continues to step 46 which determines what fueling command to give to the engine based upon the current engine speed 48 and the current commanded throttle 50. The engine speed 48 and commanded throttle 50 are derived from appropriate vehicle sensors, as is commonly known in the art. The engine speed 48 and commanded throttle 50 are used as inputs to a look-up table 52 stored in the computer memory associated with the engine control module. The table 52 contains fueling data corresponding to predetermined throttle position and engine speed combinations, in order to produce the hybrid throttle power curves of FIG. 2 (or curves analogous thereto). Therefore, the table 52 will have entries for a plurality of engine speeds 38 and a plurality of commanded throttle positions 50, wherein any particular combination will serve as an index value to select a fueling value from the table. If either the engine speed 48 or commanded throttle position 50 are not contained within the table 52, interpolation and/or extrapolation may be used in order to find a desired fueling value which corresponds to the engine speed 48 and the commanded throttle position 50.

The fueling value derived from the table 52 is stored as the variable Hybrid Power Fuel at step 54. The variable Hybrid Power Fuel contains the fueling command value that will be given to the engine fueling system if the hybrid power governor of the present invention is enabled and not overridden. Engine fueling systems that respond to fueling commands from an engine control module are well known in the art and are therefore not described in detail herein.

The process then proceeds to decision block 56 which determines if the hybrid power governor of the present invention has been overridden. This can happen, for example, if the engine is being tested at the factory and it is not desired that it be operated with the hybrid power governor, if some other vehicle subsystem (such as an automatic transmission or antilock braking system) is sending a fueling command to the engine, et cetera. In any of these cases, it is not desirable to use the Hybrid Power Fuel command value 54 therefore the data from the table 52 is not used and the 100% fueling curve 44 is used instead to determine the fueling command at step 58. The routine of FIG. 4 is then exited. On the other hand, if the decision block 56 determines that the hybrid power governor has not been overridden, then no change is made to the Hybrid Power Fuel variable established at step 54, and the process is exited.

It will be appreciated by those having ordinary skill in the art that the hybrid power governor of the present invention provides a much more desirable fueling regulation paradigm for the engine than is the case for the prior art all speed governor. Because of the provision of a knee within each percent commanded throttle curve, feedback is given to the driver as to when the hybrid power governor is beginning to transition to the 100% fueling curve. This allows the driver to increase the commanded throttle amount in order to maintain engine speed. Furthermore, if the driver elects to downshift or lighten the load placed upon the engine, the hybrid power governor gives him the opportunity to do so before transitioning to the 100% fueling curve and experiencing a loss of power and rapid vehicle slow down. The hybrid power governor of the present invention therefore provides increased driveability and more efficient operation.

While the present invention has been illustrated and described in detail in the drawings and foregoing description, the same is to be considered as illustrative and not restrictive in character, it being understood that the preferred embodiment has been shown and described and that all changes and modifications that come within the spirit of the present invention are desired to be protected.

What is claimed is:

1. A method for fueling an internal combustion engine, comprising the steps of:

(a) providing a database comprising a plurality of engine fueling command values indexed by engine speed and commanded throttle percentage, wherein for any one of said commanded throttle percentages, respective ones of said fueling command values as a function of respective ones of said engine speeds exhibit at least two slopes between a 0% fueling command value and a 100% fueling command value, wherein said at least two slopes decrease between the 0% fueling command value and the 100% fueling command value;

(b) sensing a first commanded throttle percentage of said engine;

(c) sensing a first engine speed of said engine;

(d) retrieving a first fueling command value, corresponding to said first commanded throttle percentage and said first engine speed, from said database; and (c) fueling said engine in proportion to said first fueling command value.

2. The method of claim 1, wherein step (d) includes the step of interpolating between database values when said database does not include at least one of said first commanded throttle percentage and said first engine speed.

3. A method for fueling an internal combustion engine, comprising the steps of:

(a) providing a database comprising a plurality of engine fueling command values indexed by engine speed and commanded throttle percentage, wherein for any one of said commanded throttle percentages, respective ones of said fueling command values as a function of respective ones of said engine speeds exhibit a knee between a 0% fueling command value and said 100% fueling command value, wherein said knee exhibits decreasing slope between the 0% fueling command value and the 100% fueling command value;

(b) sensing a first commanded throttle percentage of said engine;

(c) sensing a first engine speed of said engine;

(d) retrieving a first fueling command value, corresponding to said first commanded throttle percentage and said first engine speed, from said database; and (e) fueling said engine in proportion to said first fueling command value.

4. The method of claim 3, wherein step (d) includes the step of interpolating between database values when said database does not include at least one of said first commanded throttle percentage and said first engine speed.

5. A method for fueling an internal combustion engine, comprising the steps of:

(a) providing a database comprising a plurality of engine fueling command values indexed by engine speed and commanded throttle percentage, wherein for any one of said commanded throttle percentages, a rate of change of respective ones of said fueling command values as a function of respective ones of said engine speed is non-constant and decreasing between a 0% fueling command value and a 100% fueling command value;

(b) sensing a first commanded throttle percentage of said engine;

(c) sensing a first engine speed of said engine;

(d) retrieving a first fueling command value, corresponding to said first commanded throttle percentage and said first engine speed, from said database; and (e) fueling said engine in proportion to said first fueling command value.

6. The method of claim 5, wherein step (d) includes the step of interpolating between database values when said database does not include at least one of said first commanded throttle percentage and said first engine speed.

7. A hybrid power governor for an internal combustion engine having a throttle, comprising:

a computer memory device containing a database comprising a plurality of engine fueling command values indexed by engine speed and commanded throttle percentage, wherein for any one of said commanded throttle percentages, respective ones of said fueling command values as a function of respective ones of said engine speeds exhibit at least two slopes between a 0% fueling command value and a 100% fueling command value, wherein said at least two slopes decrease between the 0% fueling command value and the 100% fueling command value;

an engine control module coupled to said computer memory device for retrieving said fueling command values;

a throttle position sensor coupled to said throttle and to said engine control module and operative to sense a current commanded throttle percentage and supply said current commanded throttle percentage to said engine control module;

an engine speed sensor coupled to said engine and to said engine control module and operative to sense a current engine speed and supply said current engine speed to said engine control module; and, a fuel system coupled to said engine and to said engine control module and operative to receive a fueling command value from said engine control module and to fuel said engine in response thereto;

wherein said engine control module retrieves a current fueling command value from said database based upon said current commanded throttle percentage and said current engine speed and supplies said current fueling command value to said fuel system in order to fuel said engine.

8. The hybrid power governor of claim 7, wherein said engine control module is further operative to interpolate between database values when said database does not include at least one of said current commanded throttle percentage and said current engine speed.

9. A hybrid power governor for an internal combustion engine having a throttle comprising:

a computer memory device containing a database comprising a plurality of engine fueling command values indexed by engine speed and commanded throttle percentage, wherein for any one of said commanded throttle percentages, respective ones of said fueling command values as a function of respective ones of said engine speeds exhibit a knee between a 0% fueling command value and said 100% fueling command value, wherein said knee exhibits decreasing slope between the 0% fueling command value and the 100% fueling command value;

an engine control module coupled to said computer memory device for retrieving said fueling command values;

a throttle position sensor coupled to said throttle and to said engine control module and operative to sense a current commanded throttle percentage and supply said current commanded throttle percentage to said engine control module;

an engine speed sensor coupled to said engine and to said engine control module and operative to sense a current engine speed and supply said current engine speed to said engine control module; and, a fuel system coupled to said engine and to said engine control module and operative to receive a fueling command value from said engine control module and to fuel said engine in response thereto;

wherein said engine control module retrieves a current fueling command value from said database based upon said current commanded throttle percentage and said current engine speed and supplies said current fueling command value to said fuel system in order to fuel said engine.

10. The hybrid power governor of claim 9, wherein said engine control module is further operative to interpolate between database values when said database does not include at least one of said current commanded throttle percentage and said current engine speed.

11. A hybrid power governor for an internal combustion engine having a throttle, comprising:

a computer memory device containing a database comprising a plurality of engine fueling command values indexed by engine speed and commanded throttle percentage, wherein for any one of said commanded throttle percentages, a rate of change of respective ones of said fueling command values as a function of respective ones of said engine speed is non-constant and decreasing between a 0% fueling command value and a 100% fueling command value;

an engine control module coupled to said computer memory device for retrieving said fueling command values;

a throttle position sensor coupled to said throttle and to said engine control module and operative to sense a current commanded throttle percentage and supply said current commanded throttle percentage to said engine control module;

an engine speed sensor coupled to said engine and to said engine control module and operative to sense a current engine speed and supply said current engine speed to said engine control module; and, a fuel system coupled to said engine and to said engine control module and operative to receive a fueling command value from said engine control module and to fuel said engine in response thereto;

wherein said engine control module retrieves a current fueling command value from said database based upon said current commanded throttle percentage and said current engine speed and supplies said current fueling command value to said fuel system in order to fuel said engine.

12. The hybrid power governor of claim 11, wherein said engine control module is further operative to interpolate between database values when said database does not include at least one of said current commanded throttle percentage and said current engine speed.

* * * * *

UNITED STATES PATENT AND TRADEMARK OFFICE

CERTIFICATE OF CORRECTION

PATENT NO : 6,062,197

DATED : May 16, 2000

INVENTOR(S) : Joseph David Drake

It is certified that error appears in the above-identified patent and that said Letters Patent are hereby corrected as shown below:

On title page, item 73 Assignee
replace "Scotts Technology, Inc."
with --Seagate Technology, Inc.--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,062,197
DATED : May 16, 2000
INVENTOR(S) : Janic et al.

It is certified that error appears in the above-identified patent and that said Letters Patent is hereby corrected as shown below:

Column 2,
Line 16, please insert a period --.-- between "speed" and "Each".

Column 5,
Line 15, and 16, please change "sow-ing" to --slowing--.
Line 53, please change "th rote" to --throttle--.
Line 54, please change "Be cause" to --Because--.

Column 7,
Line 37, please change "(c)" to --(e)--.

Signed and Sealed this

Seventeenth Day of July, 2001

Nicholas P. Godici

*Attest:*

*Attesting Officer*

NICHOLAS P. GODICI
*Acting Director of the United States Patent and Trademark Office*